US010221592B2

(12) United States Patent
Rodaer et al.

(10) Patent No.: US 10,221,592 B2
(45) Date of Patent: Mar. 5, 2019

(54) PADLOCK ASSEMBLY

(71) Applicant: Master Lock Company LLC, Oak Creek, WI (US)

(72) Inventors: Mark D. Rodaer, Wauwatosa, WI (US); Daniel D. Harvey, Lake Geneva, WI (US); Rohit Dilip Kulkarni, Greendale, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 15/631,015

(22) Filed: Jun. 23, 2017

(65) Prior Publication Data

US 2018/0371802 A1 Dec. 27, 2018

(51) Int. Cl.
*E05B 67/24* (2006.01)
*E05B 67/02* (2006.01)

(52) U.S. Cl.
CPC ..... *E05B 67/24* (2013.01); *E05B 67/02* (2013.01)

(58) Field of Classification Search
CPC ..... E05B 67/24; E05B 67/02
USPC ..... 70/38 A
See application file for complete search history.

(56) References Cited

U.S. PATENT DOCUMENTS 1,387,187 A * 8/1921 Segal ..... E05B 67/063 70/38 A
1,719,637 A * 7/1929 Werner ..... E05B 67/24 70/38 A
2,282,983 A * 5/1942 Lach ..... E05B 67/24 70/370
2,460,615 A * 2/1949 Andrew ..... E05B 67/24 70/369
3,143,872 A * 8/1964 Check ..... E05B 67/24 70/38 A
3,172,279 A * 3/1965 Patriquin ..... E05B 67/24 70/38 A
3,636,738 A * 1/1972 Burakoff ..... E05B 67/24 29/520
4,528,828 A * 7/1985 Poutiainen ..... E05B 67/24 70/38 A
4,899,560 A 2/1990 Chen
4,998,422 A * 3/1991 Borgmann ..... E05B 67/24 70/367
5,174,136 A * 12/1992 Thwing ..... E05B 17/04 70/371

(Continued)

*Primary Examiner* — Suzanne L Barrett
(74) *Attorney, Agent, or Firm* — Calfee, Halter & Griswold LLP

(57) ABSTRACT

A padlock includes a lock body, a shackle receivable in first and second shackle openings in the lock body, and a locking mechanism disposed in the lock body. The locking mechanism includes at least one locking member, a key cylinder rotatable between a locked position and an unlocked position, an actuator assembled with the key cylinder for co-rotation therewith, and a torsion spring having a first end engaging the lock body and a second end engaging the actuator to rotationally bias the key cylinder toward the locked position. The actuator includes a projection that engages a portion of the lock body when the key cylinder is in a locked position, and a blocker portion aligned with the at least one locking member to hold the at least one locking member in locking engagement with the shackle when the key cylinder is in the locked position.

18 Claims, 9 Drawing Sheets

(56) References Cited

U.S. PATENT DOCUMENTS 5,186,029 A * 2/1993 Myers ..... E05B 67/24 70/371
5,394,711 A * 3/1995 Pitkanen ..... E05B 9/086 70/368
6,393,876 B1 * 5/2002 Matyko ..... E05B 67/02 70/38 A
6,766,673 B2 6/2004 Gast et al.
7,017,378 B2 * 3/2006 Hsieh ..... E05B 67/003 70/25
7,117,698 B2 * 10/2006 Lai ..... E05B 37/0034 70/21
7,278,283 B2 * 10/2007 Meckbach ..... E05B 15/16 292/DIG. 38
7,533,549 B2 * 5/2009 Gunther ..... E05B 67/02 70/38 A
7,775,071 B2 8/2010 Agbay
7,856,855 B2 * 12/2010 Fantl ..... E05B 63/0056 70/38 A
8,096,151 B2 * 1/2012 Cheevers ..... E05B 11/00 70/379 R
8,225,629 B2 * 7/2012 Zuraski ..... E05B 67/003 292/DIG. 37
8,850,858 B2 * 10/2014 Nave ..... E05B 67/22 70/21
8,904,833 B1 * 12/2014 Liu ..... E05B 67/24 70/368
2002/0046584 A1 * 4/2002 Lumpkin ..... E05B 67/24 70/38 A
2002/0078720 A1 6/2002 Watts
2003/0159479 A1 8/2003 Kajuch et al.
2003/0196461 A1 10/2003 Liou
2006/0283216 A1 * 12/2006 Marcelle ..... G07C 9/00182 70/38 A
2007/0107476 A1 * 5/2007 Ruan ..... E05B 67/02 70/38 A
2007/0234766 A1 * 10/2007 Rohde ..... E05B 67/02 70/52
2009/0158792 A1 * 6/2009 Lasaroff ..... E05B 67/24 70/38 A
2010/0095718 A1 * 4/2010 Lai ..... E05B 35/105 70/21

* cited by examiner

PADLOCK ASSEMBLY

BACKGROUND

Padlocks are used in a variety of applications, including, for example, with enclosures such as lockers, storage sheds, and various gates and doors. A typical padlock includes a generally rectangular lock body having a generally U-shaped shackle extending from one end and a keyway disposed on an opposite end. When a proper key is inserted in the keyway, a key cylinder within the lock body may be rotated to disengage a locking mechanism from the shackle, allowing the shackle to slide out of the lock body until a short leg of the shackle is fully removed or separated from the lock body, allowing removal of the lock from a hasp or other such portion of an enclosure to be locked.

SUMMARY

In an exemplary embodiment of the present application, a padlock includes a lock body, a shackle receivable in first and second shackle openings in the lock body, and a locking mechanism disposed in the lock body. The locking mechanism includes at least one locking member, a key cylinder rotatable between a locked position and an unlocked position, an actuator secured to the key cylinder for co-rotation therewith, and a torsion spring having a first end engaging the lock body and a second end engaging the actuator to rotationally bias the key cylinder toward the locked position. The actuator includes a blocker portion and a projection. The blocker portion holds the at least one locking member in locking engagement with the shackle when the key cylinder is in the locked position, and permits the at least one locking member to disengage from the shackle to permit movement of the shackle from the retracted position to the extended position when the key cylinder is in the unlocked position. The projection is received in a cutout portion of the lock body when the key cylinder is in the locked position, the cutout portion being sized to permit rotation of the actuator between the locked and unlocked positions.

In another exemplary embodiment, a padlock includes a lock body, a shackle receivable in corresponding first and second shackle openings in the lock body, and a locking mechanism disposed in the lock body. The locking mechanism includes at least one locking member, a key cylinder rotatable between a locked position and an unlocked position, an actuator secured to the key cylinder for co-rotation therewith, and a torsion spring. The actuator includes an upper portion seated in an upper recess in the lock body, and a blocker portion aligned with the at least one locking member. When the key cylinder is in the locked position, the blocker portion holds the at least one locking member in locking engagement with the shackle, and when the key cylinder is in the unlocked position, the blocker portion permits the at least one locking member to disengage from the shackle to permit movement of the shackle from the retracted position to the extended position. The torsion spring has a first end engaging the lock body and a second end engaging the actuator to rotationally bias the key cylinder toward the locked position and to axially bias the actuator upper portion into seated engagement with the lock body upper recess.

BRIEF DESCRIPTION OF THE DRAWINGS

Further features and advantages will become apparent from the following detailed description made with reference to the accompanying drawings, wherein.

DETAILED DESCRIPTION

Figure 1:
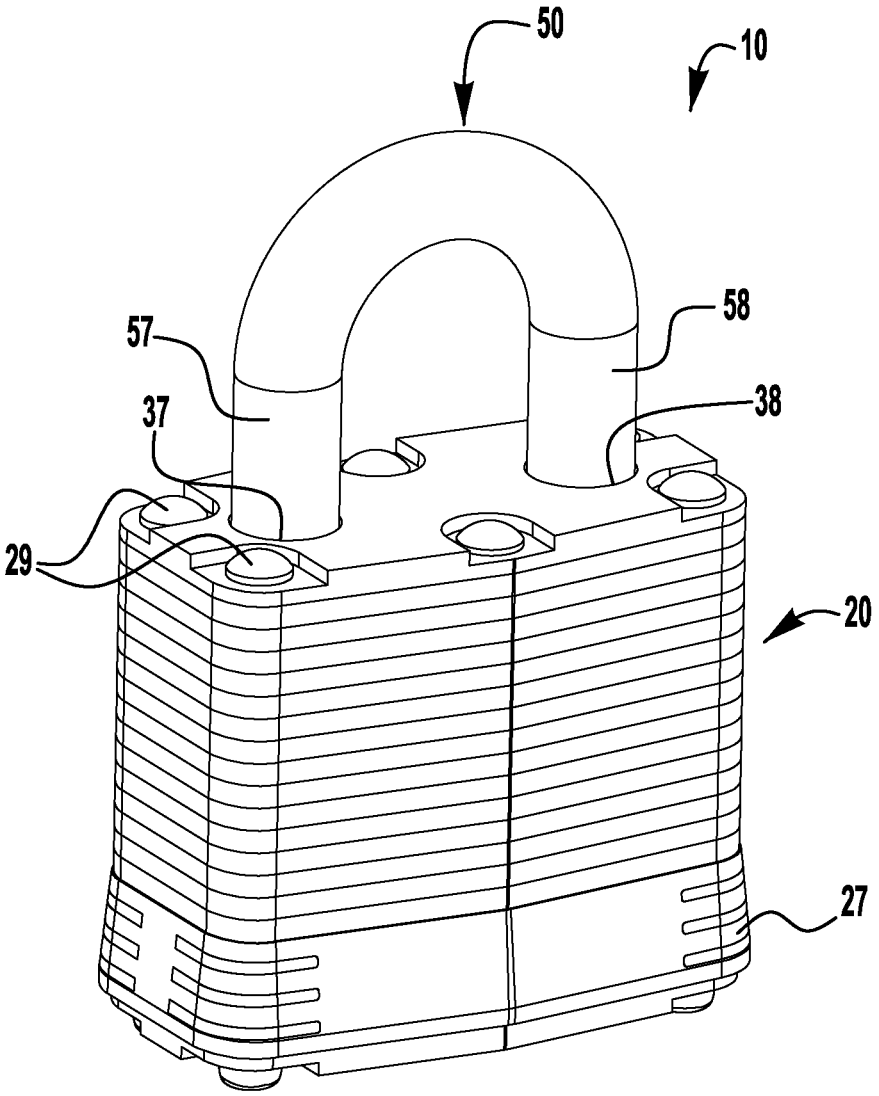
FIG. 1 is a front perspective view of a padlock in accordance with an exemplary embodiment.

This Detailed Description merely describes exemplary embodiments and is not intended to limit the scope of the claims in any way. Indeed, the invention as claimed is broader than and unlimited by the exemplary embodiments, and the terms used in the claims have their full ordinary meaning. For example, while the specific embodiments described herein relate to key operated padlocks, the features of the present application may additionally or alternatively be applied to other types of padlocks, including, for example, combination padlocks and electromechanically operated padlocks, and other types of portable locks, including, for example, cable locks, pin locks, and coupler locks.

An exemplary key cylinder padlock 10, illustrated in FIGS. 1-5A, includes a lock body 20 with a first and second shackle bores 37, 38 extending from an upper end of the lock body and retaining first and second legs 57, 58 of a generally U-shaped shackle 50. A key cylinder lock 24 is disposed in a central cavity 23 in the lock body 20 (FIGS. 2 and 3), and includes a key operated plug 41 rotatable within a shell 48, using any suitable key cylinder locking arrangement, including wafer and pin tumbler locking arrangements, as known in the art. While the lock body may be formed from a variety of suitable constructions, in the illustrated embodiment, the lock body 20 is formed from a stack of laminated plates 21*a-h* (FIG. 4), secured together by fasteners 29, and having cutouts arranged to form the shackle bores 37, 38 and central cavity 23. As shown, the key cylinder shell 48 may be provided with one or more ribs sized to provide press fit retention of the key cylinder shell within the central cavity 23. In other embodiments (not shown), a separate sleeve component may be assembled with the key cylinder shell to provide press fit retention. A soft (e.g., plastic, elastomeric) bumper sleeve 27 may be provided on a lower portion of the lock body 20.

Figure 2:
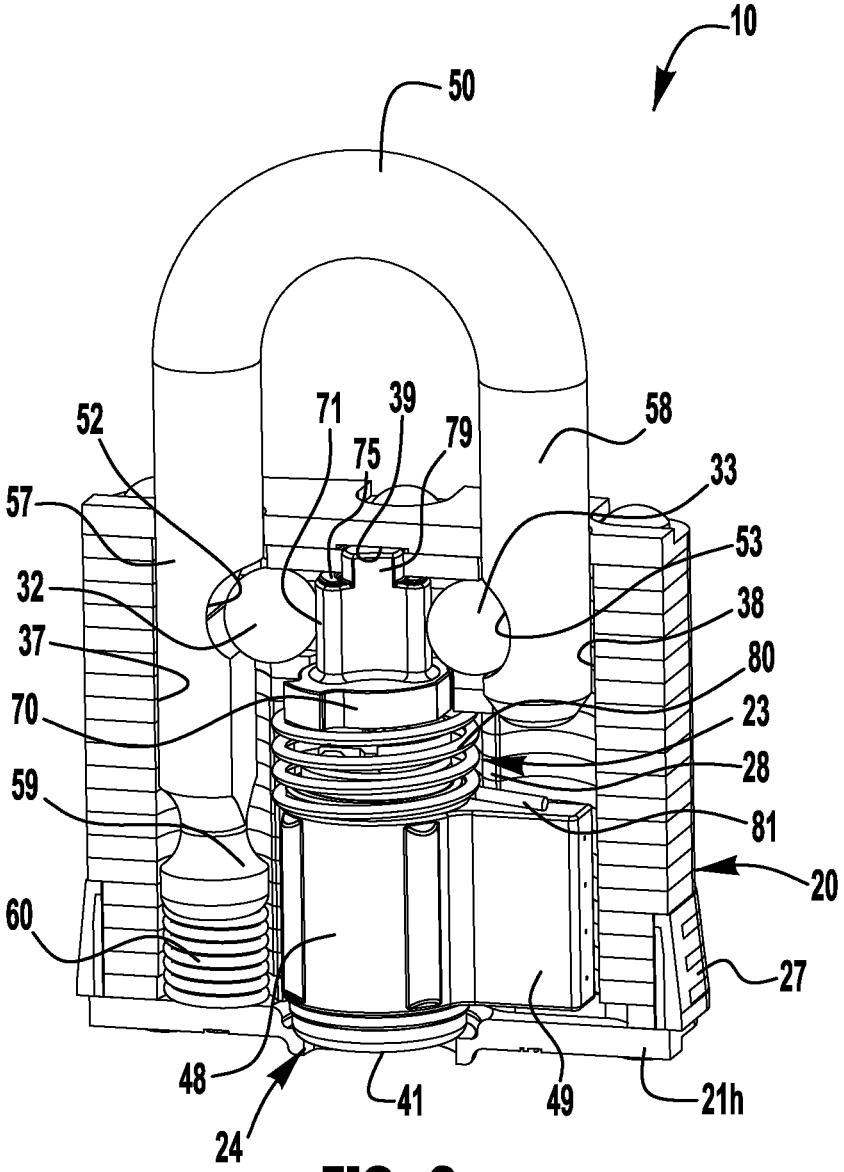
FIG. 2 is a front perspective view of the padlock of FIG. 1, shown in a locked condition with the lock body in cross-section to illustrate additional features of the padlock.
Figure 3:
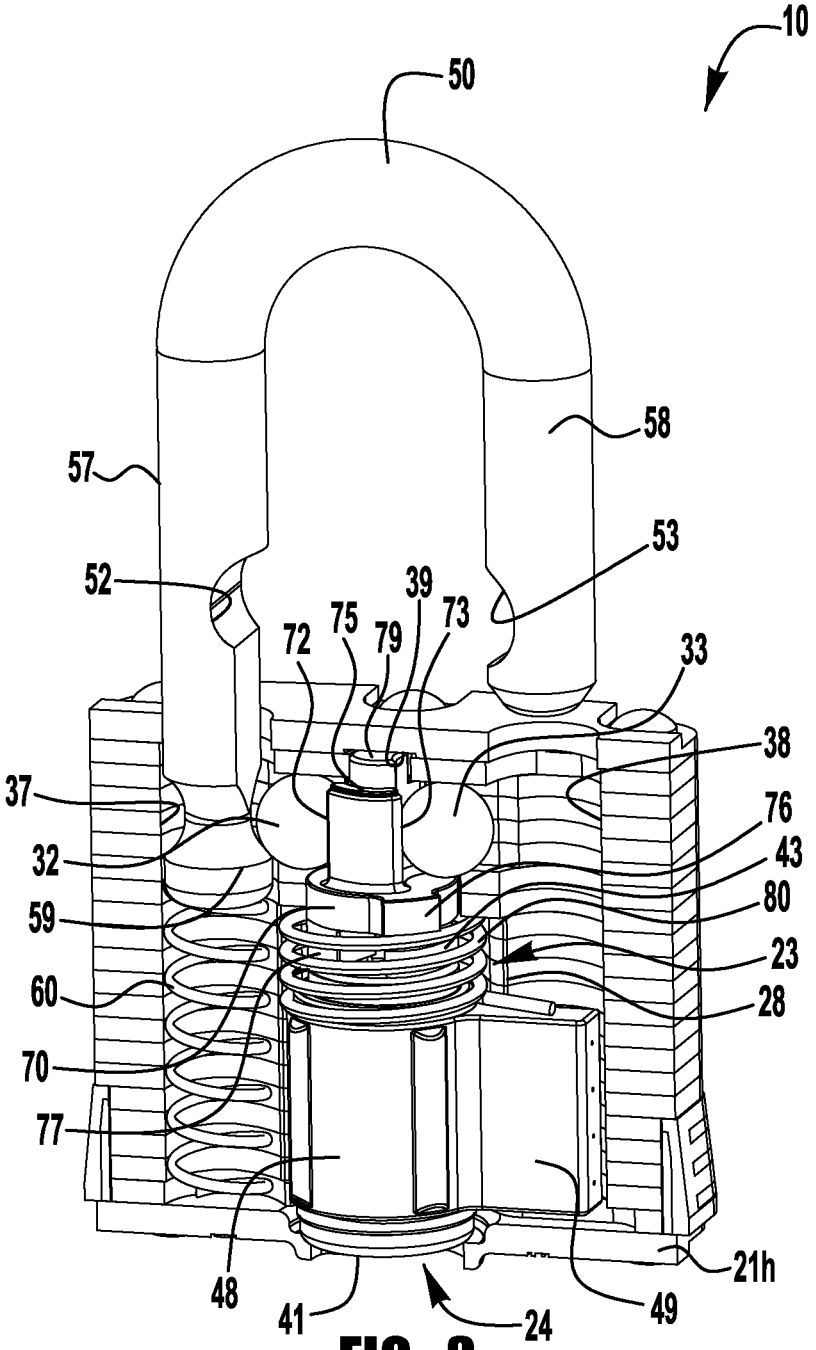
FIG. 3 is a front perspective view of the padlock of FIG. 1, shown in an unlocked condition with the lock body in cross-section to illustrate additional features of the padlock.
Figure 4:
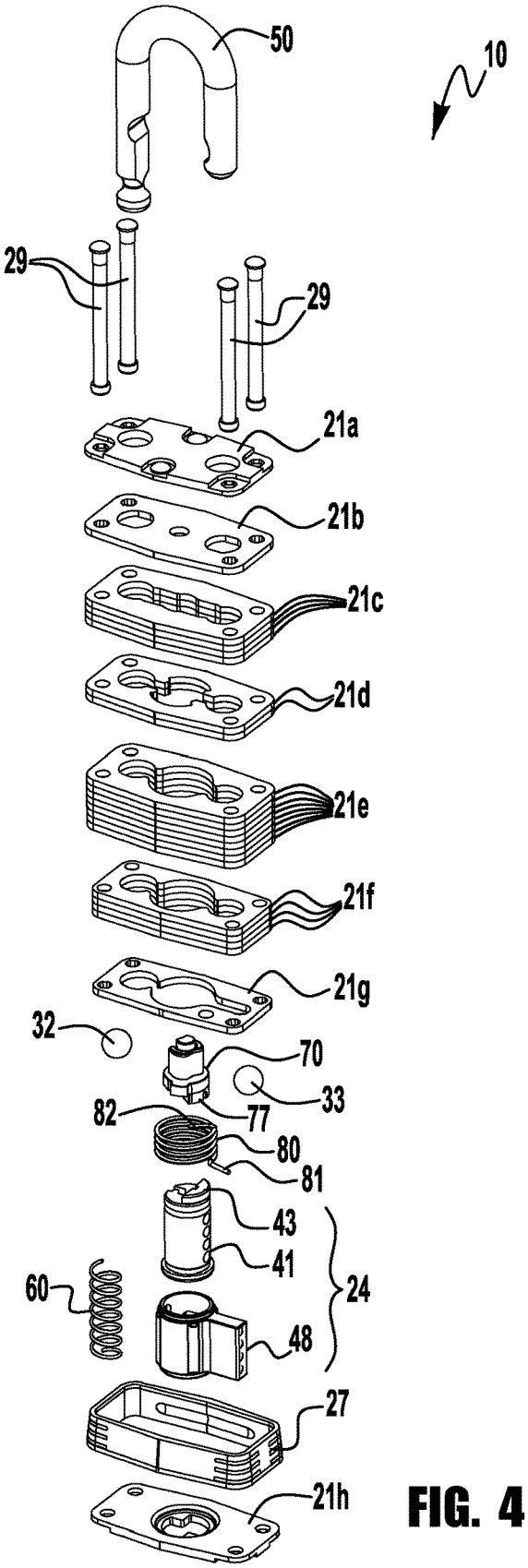
FIG. 4 is an upper exploded perspective view of the padlock of FIG. 1.
Figure 5:
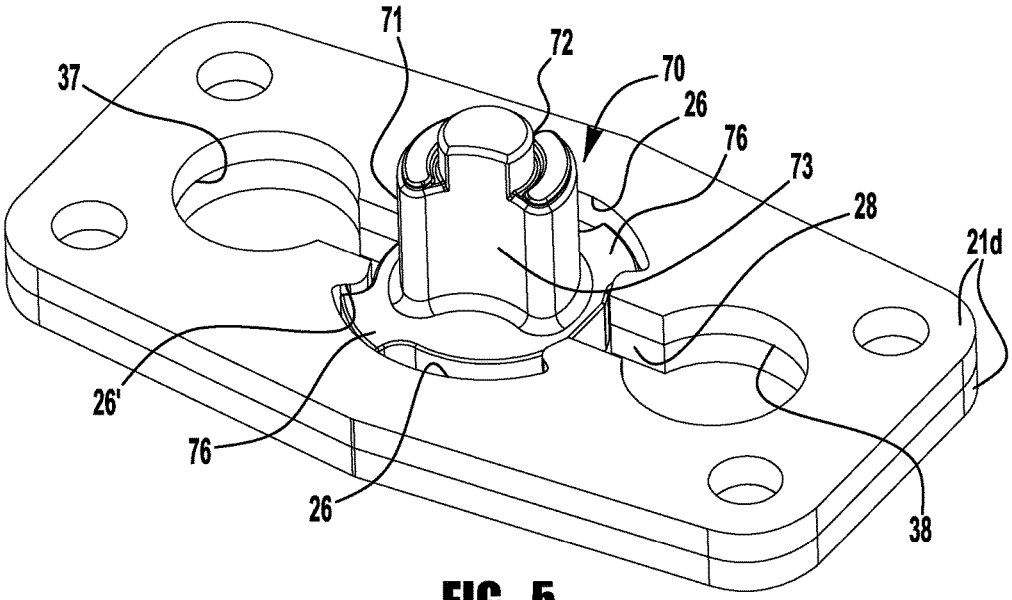
FIG. 5 is an upper perspective view of the actuator and interengaging lock body plates of the padlock of FIG. 1.
Figure 5A:
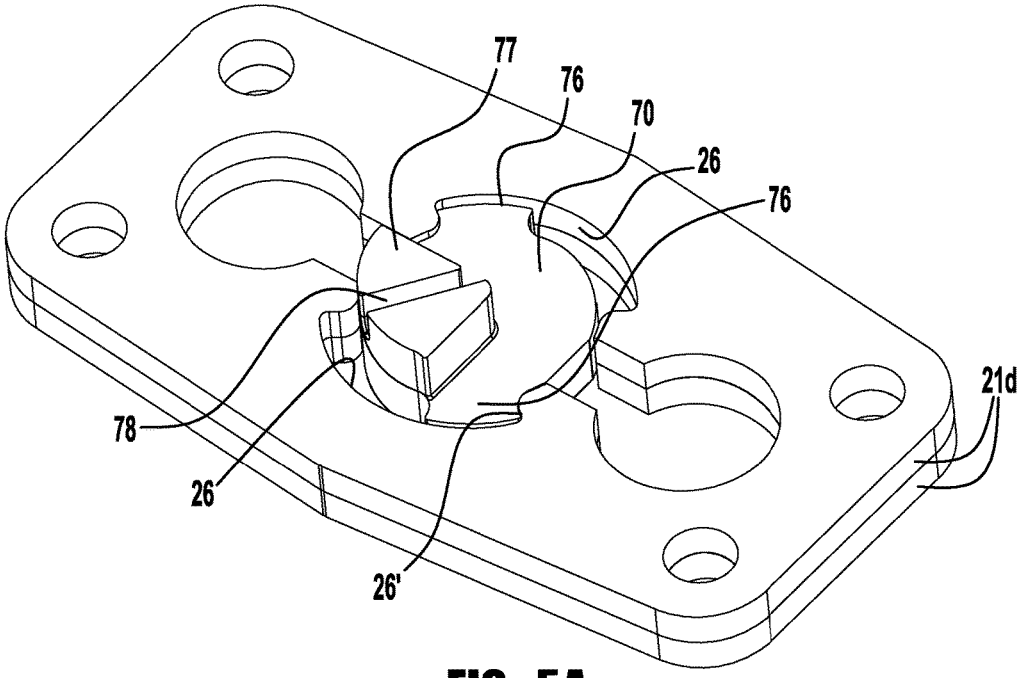
FIG. 5A is a lower perspective view of the actuator and interengaging lock body plates of the padlock of FIG. 1.
Figure 6:
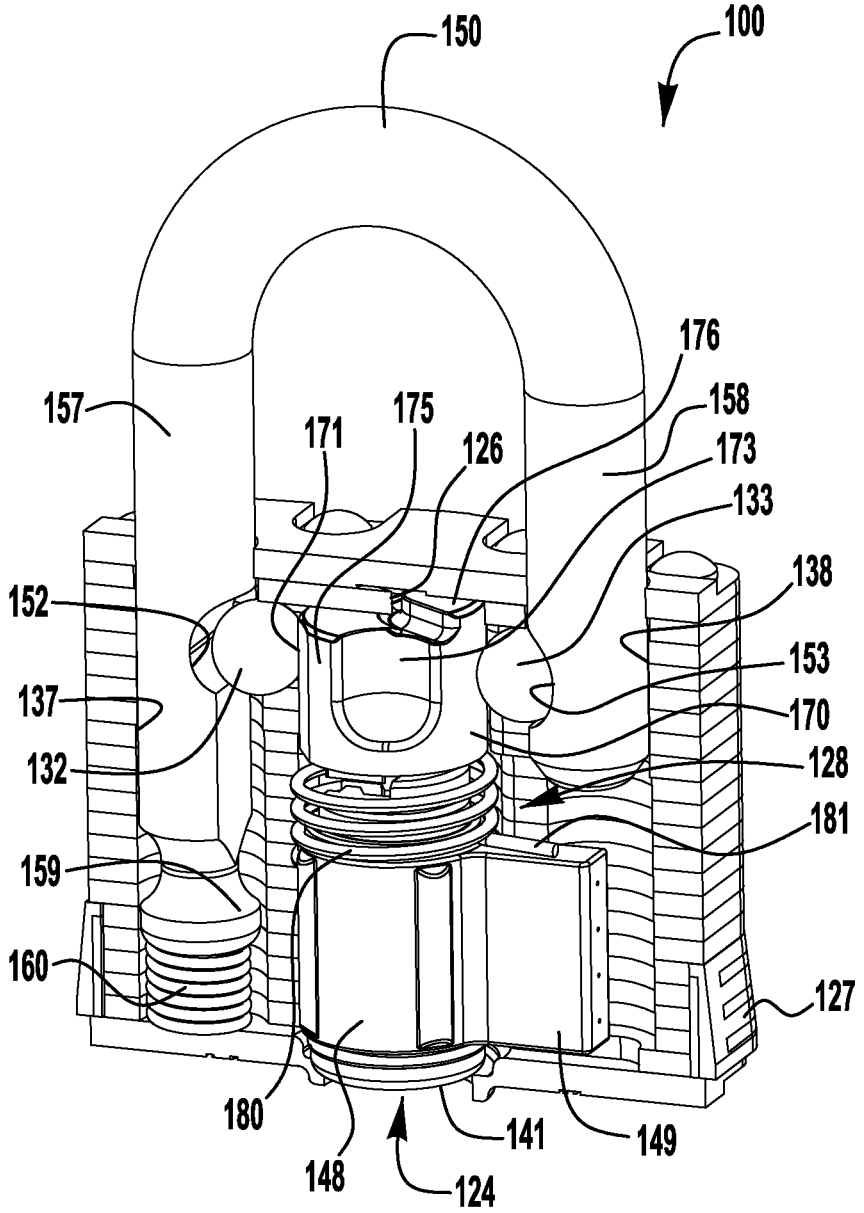
FIG. 6 is a front perspective view of a padlock in accordance with another exemplary embodiment, shown in a locked condition with the lock body in cross-section to illustrate additional features of the padlock.
Figure 7:
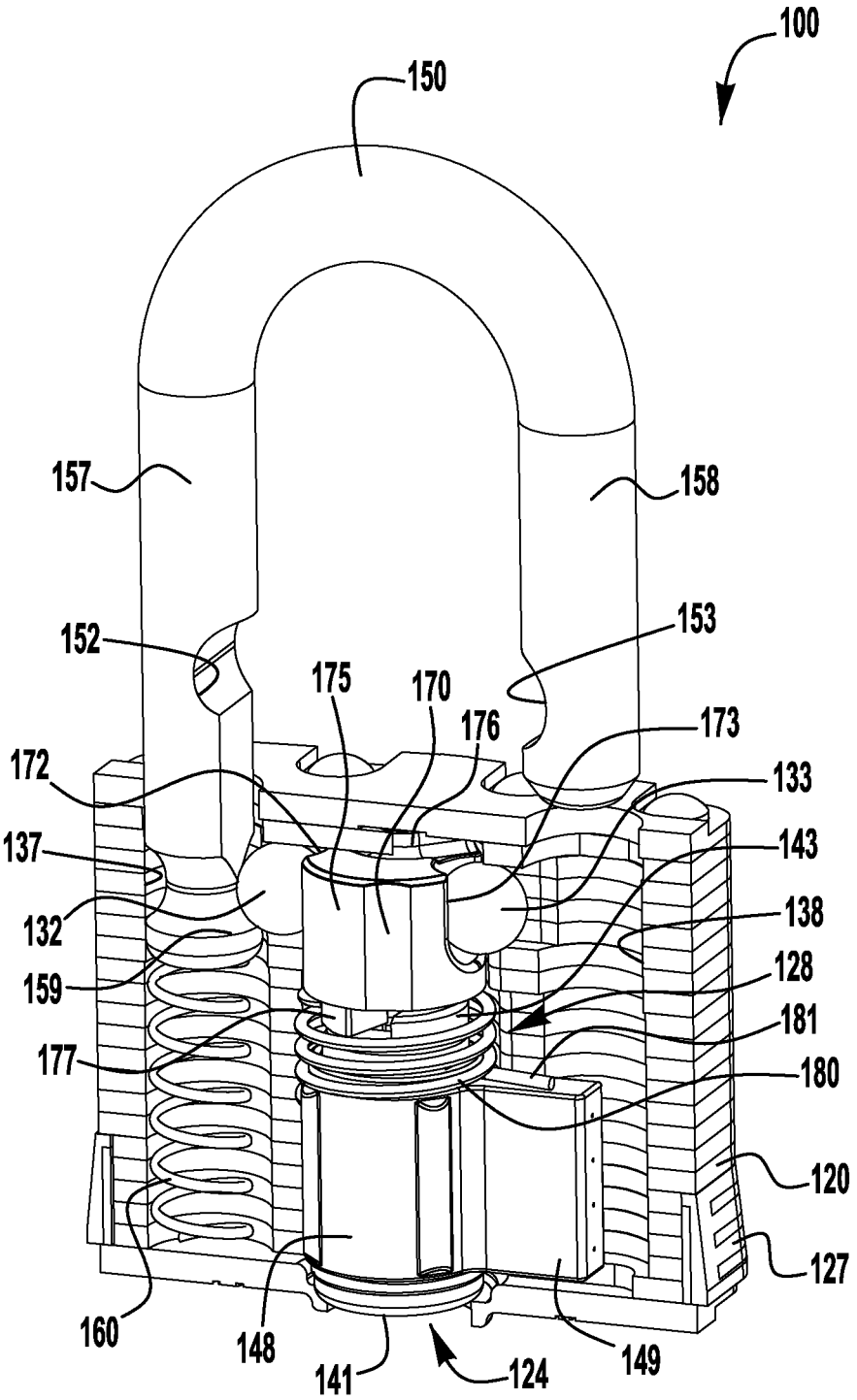
FIG. 7 is a front perspective view of the padlock of FIG. 6, shown in an unlocked condition with the lock body in cross-section to illustrate additional features of the padlock.
Figure 8:
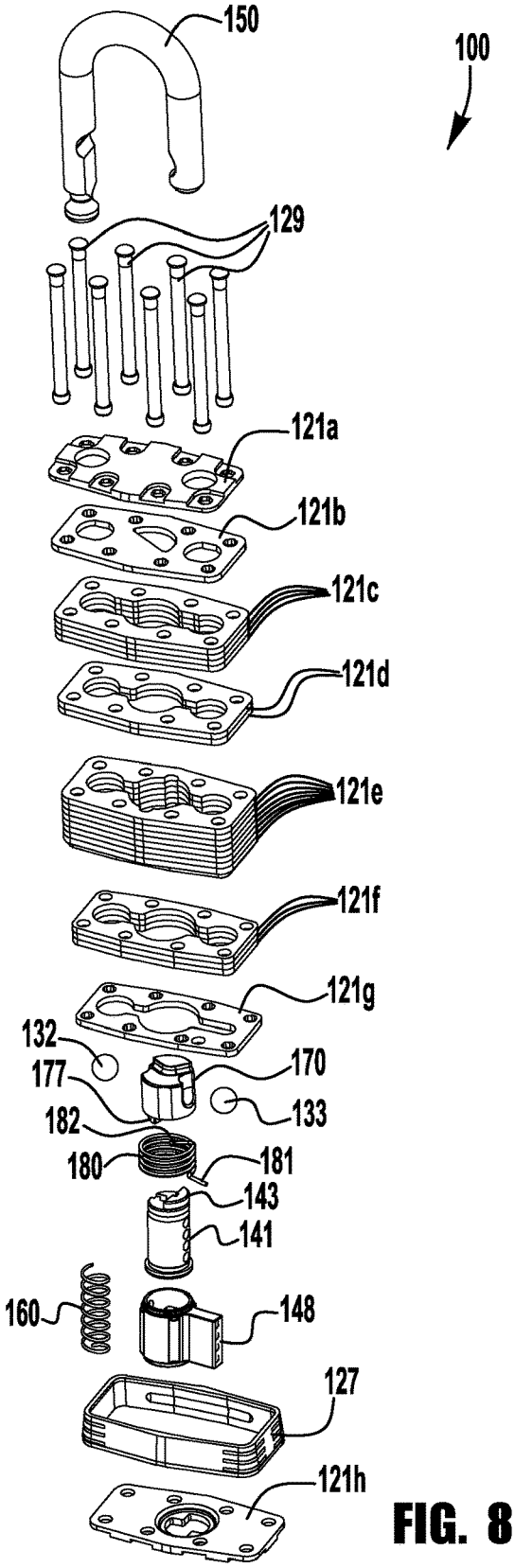
FIG. 8 is an upper exploded perspective view of the padlock of FIG. 6.
Figure 9:
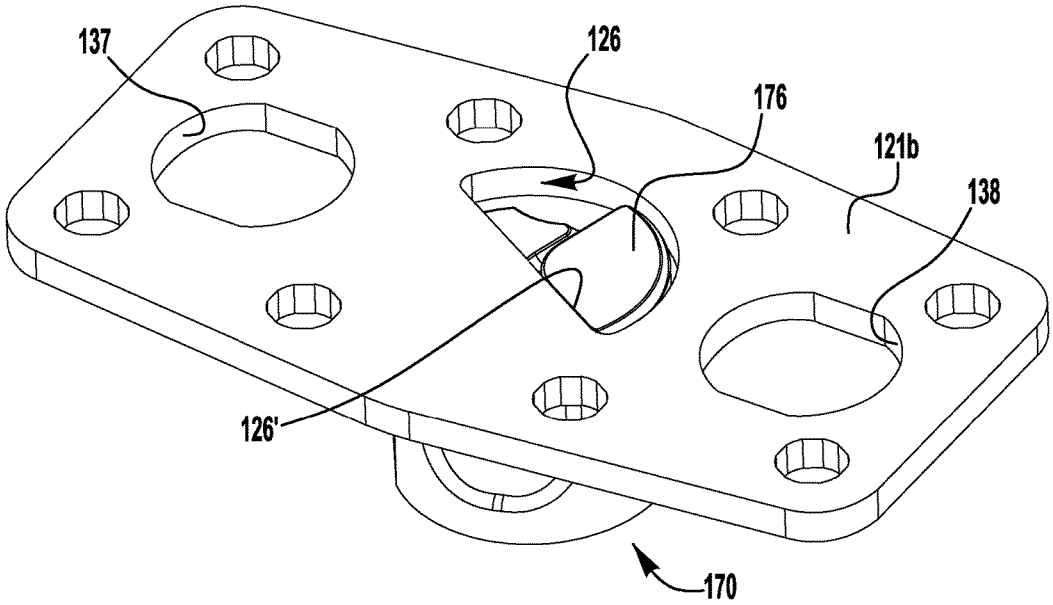
FIG. 9 is an upper perspective view of the actuator and interengaging lock body plate of the padlock of FIG. 6.
Figure 9A:
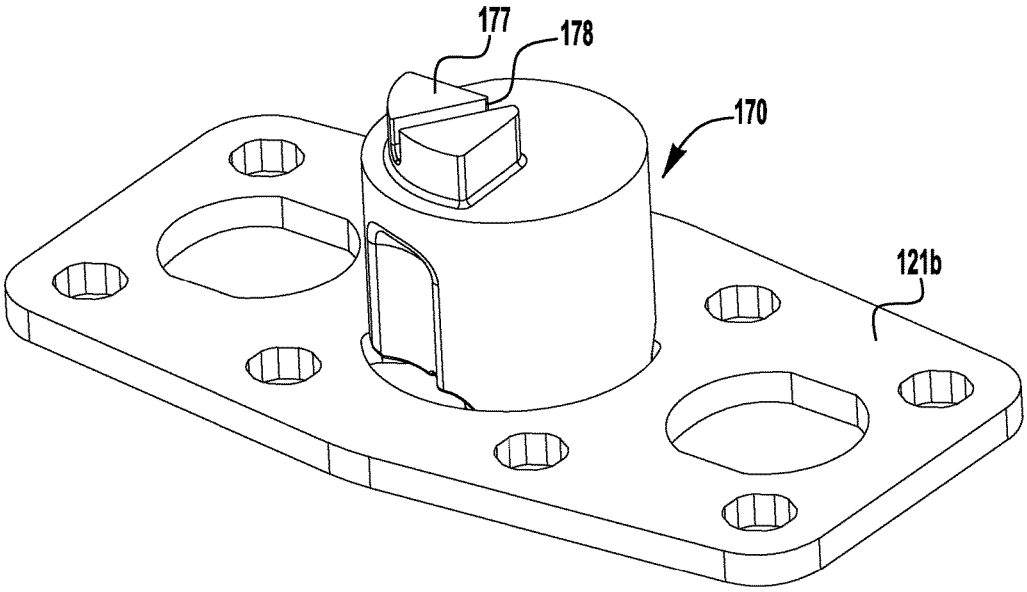
FIG. 9A is a lower perspective view of the actuator and interengaging lock body plate of the padlock of FIG. 6.

An actuator 70 is disposed in the lock cavity 23 for co-rotation with the key cylinder plug 41. Upon insertion of an authorized key in the key cylinder plug keyway (not shown), rotation of the plug 41 rotates the actuator 70 between locked and unlocked positions. When the actuator 70 is in the locked position, as shown in FIG. 2, an outer surface 71 of a blocker portion 75 of the actuator 70 holds locking members 32, 33 (e.g., locking balls) in interlocking engagement with corresponding notches 52, 53 in the shackle legs 57, 58 to prevent withdrawal of the shackle 50 to the open position. When the key cylinder plug 41 and actuator 70 are rotated to the unlocked position, as shown in FIG. 3, recesses 72, 73 in the blocker portion 75 align with the locking members 32, 33 to allow the locking members to disengage or retract from the shackle notches 52, 53, and a compression spring 60 below the long shackle leg 57 biases the shackle 50 toward a withdrawn or open position, in which the short shackle leg 58 separates from the lock body 20. An end portion 59 of the long shackle leg 57 engages the retracted locking member 32 to prevent removal of the long shackle leg 57 from the lock body 20.

When the shackle 50 is in the open position, the end portion 59 of the long shackle leg 57 holds the corresponding locking member 32 in interlocking engagement with the corresponding actuator recess 72, thus preventing rotation of the actuator 70 back to the locked position. In some key-operated padlocks, the actuator is rotationally fixed with the key cylinder plug. In such embodiments, the key cylinder plug is also held in the locked position, thereby preventing removal of the key from the key cylinder plug when the padlock shackle is open. This arrangement is commonly referred to as a "key retaining" locking arrangement.

To allow a key cylinder plug to be rotated to the locked position for removal of the key while a padlock is in the "shackle open" or unlocked condition, with the actuator being secured in the unlocked position, padlocks with "non-key retaining" locking arrangements provide for a degree of rotatability of the key cylinder plug with respect to the actuator. This rotatability or "lost motion" is often accomplished by providing the key cylinder plug and actuator with interengaging tangs, pins, extensions or other such features, that engage each other for co-rotation of the actuator with the plug from the locked position to the unlocked position, with the plug interengaging feature disengaging from the actuator interengaging feature when the key cylinder plug is rotated back to the locked position. This arrangement is commonly referred to as a "non-key retaining" locking arrangement. In the illustrated embodiment, the key cylinder plug 41 includes a semicircular shaped upper extension 43 that is axially aligned with a corresponding pie piece shaped lower extension 77 of the actuator 70. The upper and lower extensions 43, 77 are sized and shaped to permit a degree of rotation of the key cylinder plug 41 with respect to the actuator 70 that corresponds to the degree of rotation between the unlocked and locked positions of the key cylinder plug 41 (e.g., about 90°).

To facilitate re-engagement of the shackle with the locking mechanism when the shackle is forced into the closed position, the actuator may be spring biased to the locked position, for example, by a torsion spring. When the shackle is returned to the closed position, such that the shackle notches are aligned with the locking members, a spring-loaded torsional force on the actuator causes the actuator to rotate toward the locked position, forcing the locking members laterally outward into the shackle notches. In many conventional padlocks, a torsion spring is assembled between the key cylinder plug and the actuator to apply a spring-loaded torsion force between the plug and the actuator. This spring loaded plug and actuator assembly often involves one or more additional components (e.g., one or more washers, collars, inserts, etc.) for retaining, aligning, or otherwise positioning the spring with respect to the actuator, to facilitate installation of the key cylinder into the lock body. Exemplary padlocks with spring-loaded actuator-plug arrangements are disclosed in U.S. Pat. Nos. 3,793,856 and 4,998,422, the entire disclosures of which are incorporated by reference herein in their entirety.

According to an exemplary aspect of the present application, a padlock may be provided with an actuator that is spring loaded with respect to the lock body, such that during assembly of the padlock, the actuator is properly aligned in a spring loaded condition without resort to additional washers, collars, or other such components to provide the pre-loading, allowing the key cylinder to be more easily installed into the lock body for interengagement of the key cylinder plug with the actuator. In such an arrangement, the actuator may be provided as a unitary or single-piece component, thereby simplifying the construction and assembly of the padlock. This arrangement also isolates the key cylinder assembly from static load and impact with the actuator when the shackle is closed and the actuator snaps back to the locked position.

While many different body-actuator spring loading arrangements may be utilized, in one embodiment, a torsion spring is installed in the lock body with a first end of the torsion spring engaging a portion of the lock body, and a second end of the torsion spring engaging a portion of the actuator. In the exemplary embodiment of FIGS. 1-5A, a torsion spring 80 is assembled with the actuator 70 and retained within the lock cavity 23 of the lock body 20. A first end 81 of the torsion spring 80 engages an internal channel 28 in the lock body 20 extending between the lock cavity 23 and the short shackle bore 38, and a second end 82 of the torsion spring 80 (FIG. 4) is received in a notch 78 in the lower extension 77 of the actuator 70 (see FIG. 5A). As shown, the coil portion 85 of torsion spring 80 may be sized to receive an upper portion of the key cylinder plug 41 and shell 48 therein. This arrangement allows for a more compact locking mechanism design, and a shorter lock body 20. In the illustrated embodiment, the first end 81 of the torsion spring may be supported by the upper end of the bible portion 49 of the key cylinder shell 48, to vertically or axially position the spring 80 within the central cavity 23.

To pre-load the actuator 70 in a spring-biased locked position within the lock body 20, the actuator may be provided with a first engaging portion that abuts or otherwise engages a second engaging portion of the lock body in the actuator's locked position. Many different actuator-body engaging arrangements may be utilized, including for example. As one example, the actuator may be provided with one or more radially extending projections or tabs (or first engagement portions) received in corresponding cutout portions of the lock body extending radially outward from the central cavity of the lock body, and arranged for abutment of the one or more tabs with edge portions (or second engagement portions) of the corresponding cutouts when the actuator is in the locked position, and to allow for rotation of the actuator between the locked and unlocked position. In the exemplary embodiment of FIGS. 1-5A, the actuator 70 includes radially extending projections tabs 76 received in cutout portions 26 extending radially outward from the central cavity 23 in the lock body 20. In the locked position, the tabs 76 abut edge portions 26' of the cutout portions 26, with the torsion spring 80 applying a biasing force to retain the actuator 70 in the locked position. The cutout portions 26 are sized to permit rotation of the actuator 70 to the unlocked position when the key cylinder plug 41 is rotated to the unlocked position. Where the lock body is formed from a stack of laminated plates, as with the illustrated embodiment, the cutouts 26 may be formed from one or more plates 21*d* that are axially aligned with the actuator tabs 76.

In another example, a padlock actuator that is pre-loaded with the lock body may include one or more axially extending projections (or first engaging portions) received in one or more corresponding recesses extending axially from the central cavity of the lock body, and arranged for abutment of the one or more projections with edge portions (or second engagement portions) of the corresponding recesses when the actuator is in the locked position, and to allow for rotation of the actuator between the locked and unlocked position. FIGS. 6-9A illustrate another embodiment of a padlock 100 including an actuator 170, the actuator 170 includes an axially upward extending projection 176 received in a recess portion 126 extending axially upward from the central cavity 123 in the lock body 120. In the locked position, the projection abuts an edge portion 126' of the recess 126, with the torsion spring 180 applying a biasing force to retain the actuator 170 in the locked position. The recess 126 is sized to permit rotation of the actuator 170 to the unlocked position when the key cylinder plug 141 is rotated to the unlocked position. Where the lock body is formed from a stack of laminated plates, as with the illustrated embodiment, the recess 126 may be formed from one or more plates 121*b* that are axially aligned with the actuator projection 176.

Other types of lock body and actuator engagement portions may additionally or alternatively be utilized. For example, an actuator may be provided with a cutout or recesses for interengagement with a projection provided in the lock body central cavity (not shown).

According to another aspect of the present application, a spring that applies a pre-load or biasing torsion force between the actuator and the lock body of a non-key retaining padlock may additionally function as a compression spring applying an axial force to the actuator, for example, to ensure proper axial or vertical alignment of the engagement portions of the actuator and lock body, for example, to compensate for deviations in tolerance stack-ups of the padlock components. In the exemplary embodiments of FIGS. 1-9A, the helical coiled torsion spring 80, 180 may apply an axial upward force to the actuator 70, 170 to maintain axial alignment of the first engagement portion (s) or projections 76, 176 of the actuator 70, 170 with the second engagement portion(s) or cutouts 26, 126 of the lock body 20, 120, and to axially bias an upper portion of the actuator 70, 170 (e.g., the projection(s) 76, 176, or an uppermost end portion 79) into seated engagement with an upper lock body recess (e.g., the cutout(s) 26, 126, or an uppermost recess 39) and against any movement out of axial alignment.

In an exemplary method of assembling a padlock, in accordance with an aspect of the present application, a lock body 20, 120 is provided with the bottom plate 21*h*, 121*h* removed, to provide access to a central cavity 23, 123 in the lock body through the bottom end. In other embodiments (not shown), a cylinder door may be assembled to the bottom plate to retain the key cylinder lock. The legs 57, 58; 157, 158 of a shackle 50, 150 are inserted into the shackle bores 37, 38; 137, 138, and the lock members 32, 33; 132, 133 are inserted through the bottom end of the lock body 20, 120 for engagement with the shackle notches 52, 53; 152, 153. An actuator 70, 170 and spring 80, 180 are installed into the central cavity 23, 123, with the first end 81, 181 of the spring received in the channel 28, 128 between the central cavity and the short shackle bore 38, 138, and the second end 82, 182 of the spring received in the lower extension notch 78, 178 of the actuator. The actuator 70, 170 is rotated against the biasing force of the spring 80, 180 (e.g., using a tool, not shown, inserted into the central cavity) to the actuator's locked position, for alignment of the actuator projection(s) 76, 176 with the corresponding cutout(s) 26, 126 in the lock body, and the actuator is axially inserted further into the central cavity 23, 123 for receipt of the projection(s) in the cutout(s). The key cylinder 24, 124 is installed in the central cavity with the key cylinder plug 41, 141 in the locked position, to permit interengagement of the upper extension 43, 143 of the key cylinder plug with the lower extension 77, 177 of the actuator. The shackle spring 60, 160 is installed in the long shackle leg bore 37, 137, and the bottom plate 21*h*, 121*h* (or cylinder door) is installed on the end of the lock body to complete the lock assembly 10, 100.

In some embodiments (not shown), a padlock may be provided to a locksmith or end user without a key cylinder. While a dummy cylinder or spacer may be installed in the central cavity of the lock body to hold the actuator and torsion spring in place, in some embodiments, the pre-loaded condition of the actuator and torsion spring may be sufficient to retain the actuator in axial alignment with the lock members. To complete the assembly, the end user, locksmith, or other such personnel may install the key cylinder in the central cavity (after removing the dummy cylinder or spacer, where applicable) with the key cylinder plug in the locked position, to permit interengagement of the upper extension of the key cylinder plug with the lower extension of the actuator, with the bottom plate or cylinder door of the lock body being installed on the end of the lock body to complete the lock assembly.

While various aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A padlock comprising:

a lock body;

a shackle having long and short legs receivable in corresponding first and second shackle openings in the lock body, the shackle being moveable in an axial direction between a retracted position and an extended position, the short leg being withdrawn from the lock body in the extended position; and a locking mechanism disposed in a central cavity of the lock body, the locking mechanism comprising:

at least one locking member;

an actuator rotatable within the central cavity between a locked position and an unlocked position, and including a blocker portion aligned with the at least one locking member, wherein when the actuator is in the locked position, the blocker portion holds the at least one locking member in locking engagement with the shackle, and when the actuator is in the unlocked position, the blocker portion permits the at least one locking member to disengage from the shackle to permit movement of the shackle from the retracted position to the extended position; and a torsion spring having a first end engaging the lock body and a second end engaging the actuator to rotationally bias the actuator toward the locked position;

wherein the actuator comprises a projection, extending radially outward from the actuator, that is received in a cutout portion of the lock body when the key cylinder is in the locked position, the cutout portion being sized to permit rotation of the actuator between the locked and unlocked positions.

2. The padlock of claim 1, wherein the actuator projection engages the cutout portion of the lock body to pre-load the torsion spring when the actuator is in the locked position.

3. The padlock of claim 1, wherein the lock body comprises a stack of laminated plates, wherein at least one of the stack of laminated plates defines the cutout portion.

4. The padlock of claim 1, wherein the torsion spring axially biases a first portion of the actuator into seated engagement with an upper recess in the lock body.

5. The padlock of claim 4, wherein the first portion of the actuator includes the projection, and the upper recess in the lock body is defined by the cutout portion.

6. The padlock of claim 1, wherein the actuator projection comprises a first projection and the cutout portion comprises a first cutout portion, the actuator further comprising a second projection received in a second cutout portion of the lock body.

7. The padlock of claim 1, wherein the locking mechanism further comprises a key cylinder, wherein the actuator is assembled with the key cylinder for co-rotation therewith between the locked and unlocked positions.

8. A padlock comprising:

a lock body;

a shackle having long and short legs receivable in corresponding first and second shackle openings in the lock body, the shackle being moveable in an axial direction between a retracted position and an extended position, the short leg being withdrawn from the lock body in the extended position; and a locking mechanism disposed in a central cavity of the lock body, the locking mechanism comprising:

at least one locking member;

an actuator rotatable within the central cavity between a locked position and an unlocked position, and including a first portion seated in an upper recess in the lock body, and a blocker portion aligned with the at least one locking member, wherein when the actuator is in the locked position, the blocker portion holds the at least one locking member in locking engagement with the shackle, and when the actuator is in the unlocked position, the blocker portion permits the at least one locking member to disengage from the shackle to permit movement of the shackle from the retracted position to the extended position; and a torsion spring having a first end engaging the lock body and a second end engaging the actuator to rotationally bias the actuator toward the locked position and to axially bias the actuator first portion into seated engagement with the lock body upper recess;

wherein the first portion of the actuator comprises a projection that is received in the upper recess of the lock body, the upper recess being sized to permit rotation of the actuator between the locked and unlocked positions.

9. The padlock of claim 8, wherein the actuator projection engages the upper recess of the lock body to pre-load the torsion spring when the key cylinder is in the locked position.

10. The padlock of claim 8, wherein the actuator projection extends radially outward from the actuator.

11. The padlock of claim 8, wherein the actuator projection extends axially from an end portion of the actuator.

12. The padlock of claim 11, wherein the first portion of the actuator includes the projection, and the upper recess in the lock body is defined by the cutout portion.

13. The padlock of claim 8, wherein the actuator projection comprises a first projection and the upper recess comprises a first cutout portion, the actuator further comprising a second projection received in a second cutout portion of the lock body.

14. The padlock of claim 8, wherein the lock body comprises a stack of laminated plates, wherein at least one of the stack of laminated plates includes a cutout defining the upper recess.

15. The padlock of claim 8, wherein the locking mechanism further comprises a key cylinder, wherein the actuator is assembled with the key cylinder for co-rotation therewith between the locked and unlocked positions.

16. A method of assembling a padlock, comprising:

providing a lock body having a central cavity and first and second shackle bores;

installing first and second legs of a shackle in the first and second shackle bores;

inserting first and second locking members into the central cavity and into engagement with corresponding notches in the first and second shackle legs;

inserting an actuator and a torsion spring into the central cavity, such that a first end of the torsion spring is secured to the lock body and a second end of the torsion spring is secured to the actuator;

rotating the actuator against a biasing force of the torsion spring to a locked position, in which a blocking surface of the actuator is aligned with the first and second locking members, and a projection of the actuator, extending radially outward from the actuator, is rotationally aligned with a corresponding cutout in the lock body; and axially advancing the actuator into the central cavity to receive the projection in the cutout.

17. The method of claim 16, further comprising installing a key cylinder lock in the central cavity, the key cylinder lock having a key cylinder plug in a locked position, with an upper extension of the key cylinder plug in interengagement with a lower extension of the actuator.

18. The method of claim 17, wherein when the key cylinder lock is installed in the central cavity, the torsion spring functions as a compression spring to axially bias a first portion of the actuator into seated engagement with an upper recess in the lock body.

* * * * *